United States Patent [19]

Pell et al.

[11] Patent Number: 4,566,527

[45] Date of Patent: Jan. 28, 1986

[54] ISOTHERMAL HEAT PIPE SYSTEM

[76] Inventors: Kynric M. Pell, R.F.D. 2, Soldier Springs Rd.; John E. Nydahl, 1666 Diamond Head Ct., both of Laramie, Wyo. 82070

[21] Appl. No.: 186,913

[22] Filed: Sep. 15, 1980

[51] Int. Cl.[4] ..... F28D 13/00

[52] U.S. Cl. ..... 165/1; 165/45; 165/104.21; 165/104.26

[58] Field of Search ..... 126/433; 165/45, 104.26, 165/104.21, 1; 174/15 HP, 15 C, 16 B

[56] References Cited

U.S. PATENT DOCUMENTS

| | | | |
|---|---|---|---|
| 3,195,619 | 7/1965 | Tippmann | 165/1 |
| 3,521,699 | 7/1970 | Van Huisen | 165/1 |
| 3,580,330 | 5/1971 | Maugis | 165/45 |
| 3,609,206 | 9/1971 | McConnell | 174/15 C |
| 3,955,042 | 5/1976 | Kellow et al. | 174/15 C |
| 4,007,781 | 2/1977 | Masters | 165/104.21 |
| 4,050,509 | 9/1977 | Bienert et al. | 165/45 |
| 4,162,394 | 7/1979 | Faccini | 165/45 |
| 4,237,866 | 12/1980 | Rush | 126/433 |

OTHER PUBLICATIONS

M. F. Pravda et al., "Augmentation of Earth Heating for Purposes of Roadway Deicing–Final Report", Report No. FHWA-RD-79-81, prepared for Federal Highway Administration, Dec. 1978, Final Report.

A. A. Ferrara and R. Haslett, "Prevention of Preferential Bridge Icing Using Heat Pipes," Report No. FHWA-RD-75-111, prepared for Federal Highway Administration, Jul. 1975–Interim Report.

A. A. Ferrara and G. Yenetchi, "Prevention of Preferential Bridge Icing Using Heat Pipes", Report No. FHWA-RD-76-167, prepared for Federal Highway Administration, Sep. 1976–Final Report.

A. A. Ferrara and G. Yenetchi, "Prevention of Preferential Bridge Icing Using Heat Pipes," Report No. FWHA-RD-76-168, prepared for Federal Highway Administration, Sep. 1976–Executive Summary.

"Geothermal Heating of a Bridge Deck Using Heat Pipes", proposal by the Wyoming Highway Dept. to The Federal Highway Administration, Jan. 1979.

*Primary Examiner*—Margaret A. Focarino

*Attorney, Agent, or Firm*—James R. Young

[57] ABSTRACT

An isothermal heat pipe system for transferring heat from a primary fluid, such as geothermal water or steam, municipal water system, solar heated water, or the like, to another medium to be heated isothermally, such as a road or bridge deck surface, includes an elongated enclosed chamber with a volatile liquid, such as ammonia or freon, contained therein, a heat exchanger tube positioned to run through the chamber in contact with the volatile liquid, and elongated distribution pipes connected in fluid-flow relation to and extending upwardly from the upper portion of the common chamber above the level of the volatile fluid and extending into divers portions of the medium to be heated in spaced-apart relation to each other in such a manner that there is a continuous downward gradient in each of the distributor tubes from the distal end thereof to the chamber. The primary heated fluid is circulated through the heat exchanger tubes, and a wick material is attached to the external surface of the heat exchanger tube to increase surface area for transfer of heat from the heated primary fluid in the heat exchanger tube to the volatile fluid in the chamber around the heat exchanger tube.

10 Claims, 4 Drawing Figures

ISOTHERMAL HEAT PIPE SYSTEM

BACKGROUND OF THE INVENTION

This invention is related to a heat transfer method and apparatus, and more specifically to a method and apparatus for efficiently transferring heat energy from a primary heated fluid to heat a secondary medium, such as a bridge deck, isothermally.

In a variety of industrial and commerical situations, it is desirable to utilize the energy from a primary source of heated fluid to heat a different medium. In most such applications, a conventional heat exchanger can be utilized wherein the primary heated fluid can be brought into close proximity with the medium to be heated and allow the heat to transfer by conduction from the primary heated fluid to the medium to be heated. However, there are situations in which it is not desirable to conduct the primary heated fluid into close proximity with the medium to be heated. An example of such a use is where it is desired to utilize geothermally heated water to heat a road surface, such as a road surface on a bridge deck, to prevent the formation of ice and snow thereon. The U.S. Pat. No. 3,580,330, invented by P. Maugis, discloses the use of geothermally heated water for such heating purposes as urban heating, and U.S. Pat. No. 3,521,699, issued to A. T. Van Huisen, discloses the use of geothermally heated water to heat agricultural lands as well as to heat road surfaces. However, there are some significant problems associated with such systems that flow the geothermally heated water through pipes embedded directly in road surfaces on highways, bridges, runaways and the like, since a variety of failure modes can and often do lead to freezing of the water in the embedded pipes causing fracture of the piping as well as fracturing the road or bridge surface in which the pipes are embedded. Also, during such failure, large quantities of water could be leaked onto the road or runway surface and freeze in a cold atmosphere causing severely hazardous slippery conditions on the road surface.

It is also known in the prior art to utilize latent heat in the ground to heat road surfaces by the use of devices, commonly referred to as heat pipes to transfer the heat from the ground to the road surface. Such heat pipe devices are disclosed in the U.S. patents issued to J. Tippman, U.S. Pat. No. 3,195,619, to E. Faccini, U.S. Pat. No. 4,162,394, and W. Bienert et al, U.S. Pat. No. 4,050,509. Such heat pipe devices generally include an elongated vertical section driven a substantial distance into the ground and a horizontal section extending into the road surface. The Tippman device also discloses several horizontal or condenser portions branching off from the vertical section of the pipe. The interior of such heat pipes usually have a volatile liquid, such as ammonia, placed therein, which vaporizes due to the heat in the ground. The vapor migrates upwardly through the pipe to the road surface where it comes in contact with cooler portions of the pipe. Upon entering the cooler zone, the vapor condenses and gives up its heat of vaporization in the roadway surface. While such conventional heat pipe arrangements have been beneficial in heating road surfaces, there are still a number of problems that have not heretofore been solved by them. For example, in mountainous or rocky terrain it is impractical or at least quite costly to drive or embed the vertical portions of the heat pipes a sufficient distance into the ground to tap a sufficient heat source for heating the road. Extended periods of cold atmospheric conditions tend to deplete the heat source in the immediate vicinity of the ground adjacent the heat pipes so that the available heat is insufficient to keep the road surface above freezing. The down-pumping heat pipes in the Bienert et al patent, U.S. Pat. No. 4,050,509, provide one at least partial solution for this problem. The distance between the ground and bridge decks cause additional costs, heat loss, and other problems that detract from the economy and effectiveness of conventional heat pipe apparatus for use in heating bridge decks. Also, the heat transferred from the ground to the road surface by such heat pipe devices tends to be localized and temperatures vary substantially over a range of road surface many times resulting in localized patches of ice or snow forming on some portions of the road surface. This problem is particularly aggrevated on bridge surfaces where some portions of the bridge deck might be shaded from the sun while other adjacent portions are heated by the sun's rays.

There exists a need therefore for an apparatus capable of transferring heat from geothermally heated fluid to a road surface on a bridge deck or the like without allowing the geothermal water or steam to come in contact with the road surface, as well as to distribute the heat over a section of the road surface in an isothermal manner to compensate for areas that might receive varying or different amounts of heat or cold from the sun as it changes position in the sky, or from wind, snow and the like.

SUMMARY OF THE INVENTION

Accordingly, it is an object of the present invention to provide a method and apparatus for transferring heat from a primary heated fluid isothermally to divers portions of a different medium to be heated.

It is also an object of the present invention to provide a method and apparatus for efficiently utilizing heat from a primary heated fluid to heat another medium without bringing the primary heated fluid into close proximity with the medium to be heated.

Another object of the present invention is to provide a method and apparatus for isothermally heating a road surface with geothermally heated water or steam without conducting the heated water or steam through the road surface.

A still further object of the present invention is to provide a method and apparatus of isothermally heating a section of road surface on a bridge deck regardless of variations in external atmospheric or solar heat incidence on varying portions of section of road surface being heated.

The present invention is directed to a new and novel method and apparatus for transferring heat from a source of primary heated fluid isothermally to divers portions of a different medium to be heated. It includes a container having an enclosed chamber therein, a volatile liquid, such as ammonia or freon, in the container, a plurality of distribution tubes connected to and extending upwardly from the common chamber and into divers portions of the medium to be heated for conducting vapors of the volatile fluid to the various portions of the material to be heated, and a heat exchanger in the container for transferring heat from the primary heated fluid to the volatile liquid in the container. The heat exchanger is provided with a wick on its external surface to maximize the effective area of heat transfer between the heat exchanger and the volatile liquid. The distribution tubes are preferably individually connected to and extend upwardly from the top portion of a common chamber in the container in spaced-apart relationship to each other with the distal ends of the tubes extending to divers portions of the section of road surface to be heated. The method of transferring heat isothermally with this apparatus includes circulating the heated primary geothermal water or steam through the heat exchanger tube where the heat is conducted through the wall of the exchanger tube to the volatile liquid. The volatile liquid is vaporized in the common chamber by the heat and convected through the distributor pipes to the divers portions of the road surface. The cool environment of the road surface causes the vapor in the tubes to condense thereby liberating the latent heat of vaporization which is transferred through the tube walls to heat the surrounding pavement medium on the bridge deck.

DESCRIPTION OF THE DRAWINGS

Other objects, advantages and capabilities of the present invention will become more apparent as the description proceeds, taken in conjunction with the accompanying drawings, in which.

DESCRIPTION OF THE PREFERRED EMBODIMENT

Figure 1:
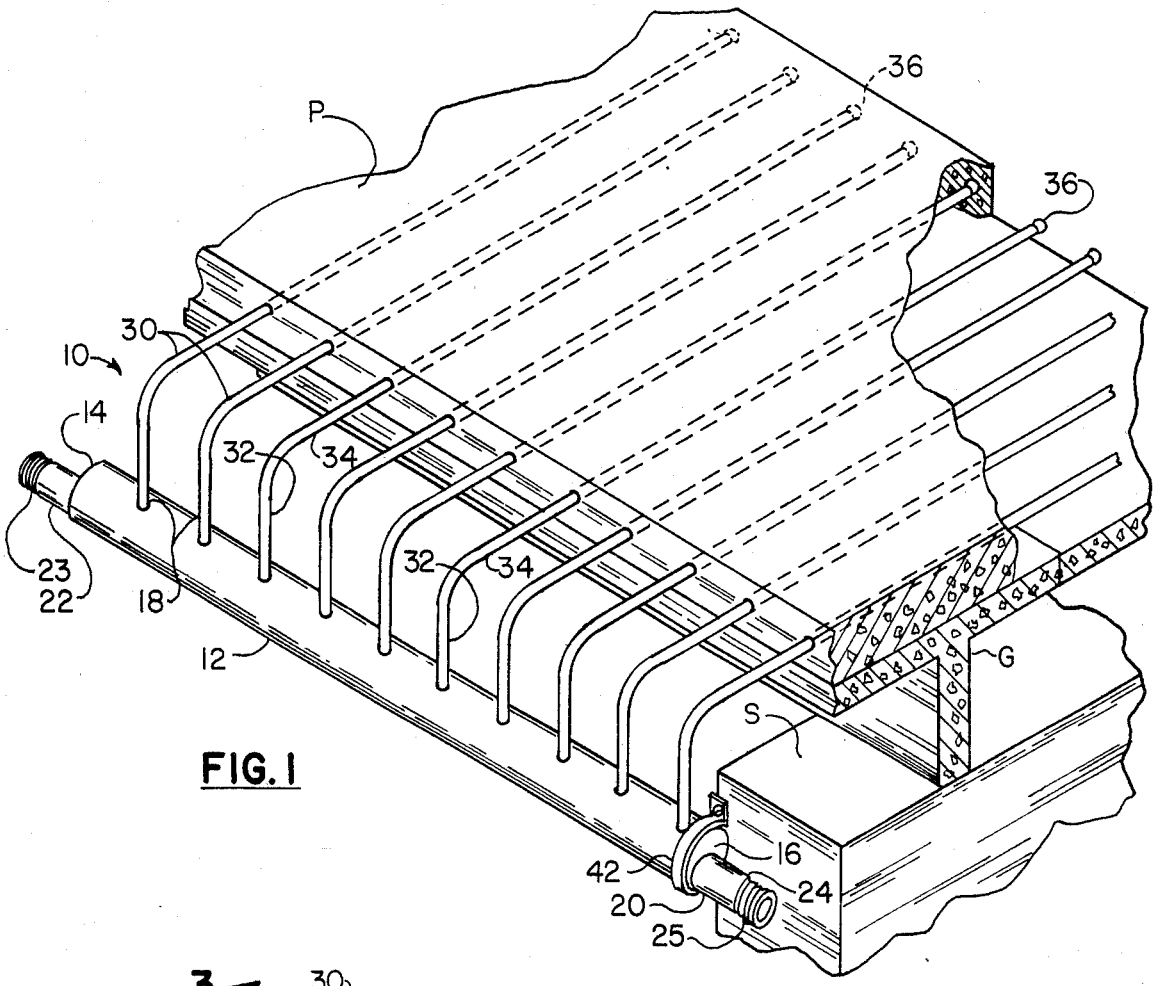
FIG. 1 is a perspective view of the isothermal heat pipe system of the present invention as arranged to isothermally heat a portion of road surface on a bridge deck.
Figure 2:
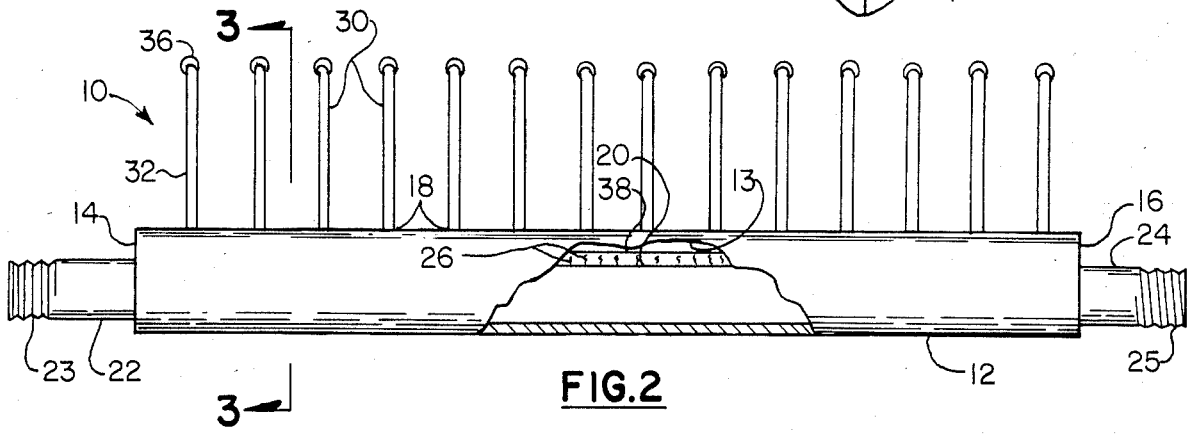
FIG. 2 is an elevation view of the isothermal heat pipe system with a portion of the side wall cut away to show the interior therof.

The isothermal heat pipe system 10 of the present invention is shown in FIG. 1 mounted on a bridge to heat a paved road surface P on the bridge deck. The paved road surface P is laid on a platform or deck comprised of a plurality of T-shaped girders G and supported by the pier S in the conventional manner.

Figure 3:
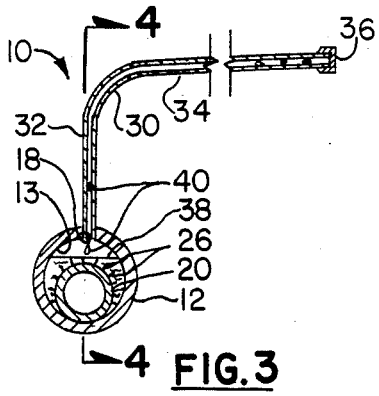
FIG. 3 is a cross-sectional view of the isothermal heat pipe system taken along lines 3—3 of FIG. 2.
Figure 4:
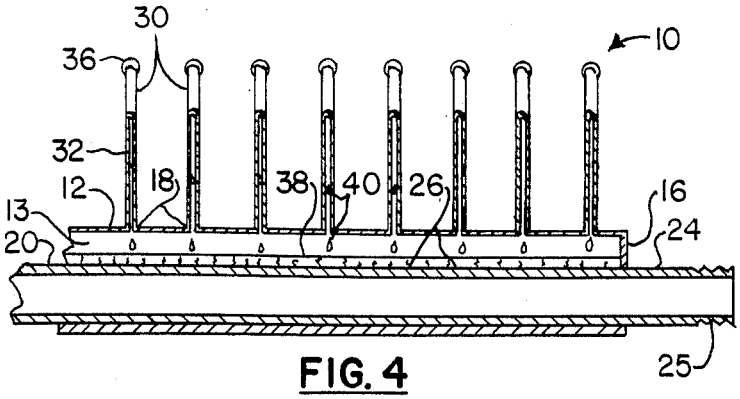
FIG. 4 is a cross-sectional view of the isothermal heat pipe system taken along lines 4—4 of FIG. 3.

The isothermal heat pipe system 10 is comprised essentially of a manifold casing 12 in the form or a horizontal elongated cylinder positioned laterally adjacent to and lower than the pavement P. A bracket 42 is shown in FIG. 1 to secure the casing 12 to the pier S. A plurality of distribution tubes or heat pipes 30 are connected to the top of the casing 12 in spaced-apart relation to each other along the length of the casing 12. Each distribution tube 30 has a substantially vertical riser section 32 and a nearly horizontal condenser section 34. The condenser section 34 extends into the pavement P at a slight angle from horizontal such that all portions of the distribution tubes 30 have downward gradients from their distal ends 36 to the casing 12. The downward gradient causes all liquid 40 condensed in the distribution tubes 30 to drain into the common chamber 13. Each distribution tube 30 is connected into a respective hole 18 in the top of casing 12 such that the hollow interior of the distribution tube 30 is in fluid-flow communication with the interior chamber 13 of the casing 12, as shown in FIGS. 3 and 4. Each end 14, 16 of casing 12 is closed so that the interior of casing 12 is an enclosed chamber 13.

A heat exchanger flow pipe 20 is positioned to extend longitudinally through the casing 12 with its ends 22, 24 extending through casing ends 14, 16 respectively. The flow pipe 20 is preferably positioned at or near the bottom of chamber 13 in casing 12 so that a volatile fluid 38, such as ammonia or freon, can be placed in the chamber 13 to substantially cover the flow tube 20 yet leave a free space above the fluid level in the chamber 13, as shown in FIGS. 3 and 4. The ends 22, 24 of flow tube 20 are provided with suitable connectors such as the threads 23, 25, respectively, for connecting the flow pipe 20 in fluid-flow relationship with a supply circulation pipe, not shown, to carry a heated primary fluid, such as geothermally heated water or steam through the flow tube 20. A wick material 26 can be provided on the external surface of the flow pipe 20 inside the chamber 13 to increase the effective surface area of heat transfer by conduction from the flow tube 20 to the volatile fluid 38 in the chamber 13.

The method of transferring heat from a primary heated fluid, such as geothermal water or steam, isothermally to divers portions of a different medium to be heated, such as a paved road surface P on a bridge can be accomplished with the apparatus described above. Essentially, the geothermally heated water or steam is circulated or directed to flow through the heat exchanger pipe 20, from where heat from the geothermally heated water is transferred by conduction through the walls of the heat transfer pipe 20 and wick 26 to the volatile fluid 38 in the chamber 13. Sufficient heat is so conducted into the volatile fluid 38 so that the volatile fluid absorbs heat of vaporization and vaporizes to a vapor or gaseous state. The vapor then moves by convection through the chamber 13 into individual ones of the distribution pipes 30 and continues upwardly and laterally in the distribution pipes in the horizontal portions 34 embedded in the pavement P. The vapor then condenses on the cooler walls of condenser portions or horizontal portions 34 of the distribution pipe 30 which are cooler due to the surrounding environment of a cool pavement P that is cooled by the atmosphere. As the vapor condenses on the walls of the condenser portion 34 of the distribution pipe 30, it gives up the latent heat of vaporization which is transferred through the walls of the distributor tubes 30 by conduction into the pavement P, thereby heating the pavement. Because there is a continuous downward gradient from the distal end of the distribution pipes to the casing 12, the condensed liquid 40 on the walls of the distribution tubes 30 drain back down into the chamber 13 under the influence of gravity and the cycle continues.

A significant feature of this invention is that the plurality of distribution tubes are connected to and emanate from a common chamber 13 heated by the geothermal fluid in the heat exchanger pipe 20. This feature allows the apparatus of the present invention to draw heat from the geothermal primary fluid and transfer the heat to isothermally heat the pavement section into which the distribution tubes 30 extend in spaced-apart relation to each other. As mentioned above, the vapor of the volatile fluid 38 is convected from the common chamber 13 into the individual distributor pipes 30 under the forces of buoyancy and the pressure gradient induced within the common chamber 13 and the individual distribution pipes 30. The condensation of the vapor on the walls of each of the distribution tubes 30 tends to reduce the local vapor pressure in the area of condensation, which in turn generates the pressure gradient that drives the convection of the vapor from the region of the wick 26 in chamber 13 into the distribution pipes or tubes 30. If one or some of the distribution pipes 30 are lower temperatures than others, the condensation rate in those tubes at lower temperatures will be greater than condensation in the tubes at higher temperatures. Therefore, because of the increased rate of condensation, the vapor pressure in the lower temperature pipes 34 will be lower than the vapor pressure in the higher temperature pipes, causing increased convection from the common chamber 13 to the lower temperature pipes 30, thereby carrying increased amounts of heat to the lower temperature pipes than to the higher temperature pipes.

This increased rate of heat flow to the lower temperature pipes, of course, causes a higher rate of heat transfer to the colder portions of the pavement section P. Consequently, over a period of time, the increased rate of heat transfer to the colder sections of the pavement will tend to raise the temperature of that portion of the pavement thereby bringing all of the distribution pipes 30 and the adjacent areas of pavement to the same temperature and automatically maintain this isothermal condition in the pavement section. If, for example, the sun is shining on one portion of the pavement section and the remaining portion of the pavement section is in the shade, the shaded portion will probably be cooler than the portion on which the sun's rays impinge. The cooler condition of that shaded section of pavement will cause the temperatures of the distribution pipes embedded in that section to be lower than the temperatures of the distribution pipes in the portion of pavement on which the sun shines. However, under the action just described above with this method of transferring heat from a geothermal fluid source to the pavement, an increased rate of heat flow will automatically be distributed from the common chamber 13 into the cooler section of pavement as dictated by the differential pressure gradient in the distribution pipes 30 and thereby tend to raise the temperature of the shaded portion of pavement to equalize with the temperature of the portion of pavement exposed to the sun. In this manner, patchy areas of warmer and colder pavement causing ice spots on the road that could be extremely hazardous to vehicular traffic can be eliminated.

Although the present invention has been described with a certain degree of particularity, it is understood that the present disclosure has been made by way of example and that changes in details of structure may be made without departing from the spirit thereof.

What is claimed is:

1. Apparatus for transferring heat from a primary heated fuild isothermally to divers portions of a different medium to be heated, comprising:

container means for containing a volatile liquid in an enclosed chamber;

a volatile liquid in said container means and only partially filling said container means such that a portion of the interior of said container means extends above the surface of said volatile liquid;

distribution means for distributing vapor of said volatile liquid to divers portions of said medium to be heated, said distribution means including a plurality elongated extensions of said container means connected in fluid-flow relation to and extending outwardly from said portion of said container means above the surface level of said volatile liquid in said container means into divers portions of said medium to be heated in spaced-apart relation to each other in such a manner that there is a continuous downward gradient in each of said extensions from the distal end thereof to said container means; and heat exchanger means in said container means for transferring heat from the primary heated fluid to the volatile liquid in said container means.

2. The apparatus of claim 1, wherein said container means includes an elongated hollow casing positioned with its longitudinal axis substantially horizontal, and said extensions include a plurality of elongated hollow distributor tubes individually connected to and extending upwardly from the top portion of said casing in spaced-apart relation to each other.

3. The apparatus of claim 2, wherein said heat exchanger means includes an elongated hollow heat exchanger tube extending through the interior of said chamber and adapted to conduct flow of said primary fluid therethrough.

4. The apparatus of claim 3, wherein said elongated hollow heat exchanger tube is positioned in the lower portion of said chamber with its longitudinal axis substantially parallel to the longitudinal axis of said casing and with its ends extending through opposite ends respectively of said casing.

5. Heating apparatus for road surfaces, comprising:

an elongated, enclosed chamber adapted to be placed in a substantially horizontal position adjacent and substantially parallel to the road surface in a plane lower than the roadway surface;

a volatile liquid in said chamber and only partially filling said chamber in such a manner that the upper portion of said chamber does not contain liquid along substantially its entire length;

a plurality of heat pipes in the form of elongated hollow tubes connected in spaced-apart relation to each other and extending upwardly from said upper portion of said chamber to a position adjacent a lateral edge of the material of which the road surface is comprised and from that position extending laterally outward at a slight angle upward from horizontal and adapted to be embedded in spaced-apart relation to each other in the road material near the surface thereof, the ends of said tubes connected to said chamber each being respectively in fluid-flow communication with the interior of said upper portion of said chamber above the liquid surface level therein in such a manner that vapors of said volatile liquid can flow from any position in said upper portion of said container to any of said hollow tubes as determined by the differential pressure gradients therein and the distal ends of said tubes being closed and sealed respectively; and an elongated hollow flow pipe extending through the interior of said chamber and adapted for conducting flow of fluid therethrough but not in fluid-flow communication with said chamber.

6. The heating apparatus of claim 5, wherein said elongated flow pipe is positioned longitudinally in the lower portion of said chamber with one end of said flow pipe extending outwardly through one end of said elongated chamber and the other end of said flow pipe extending outwardly through the other end of said elongated chamber.

7. The heating apparatus of claim 6, wherein said volatile fluid in said chamber substantially covers said flow pipe.

8. The heating apparatus of claim 6, including means attached to and extending radially outwardly from said flow pipe for increasing the effective surface area of contact between said flow pipe and said volatile fluid.

9. The heating apparatus of claim 7, wherein said heat pipes are connected to said chamber in spaced-apart relation to each other along substantially the entire length of said chamber.

10. The method of transferring heat from a primary heated fluid isothermally to divers portions of a pavement slab to be heated, comprising the steps of:

positioning a container for containing a volatile liquid in an enclosed chamber adjacent to and lower than the pavement to be heated;

placing a volatile liquid in the enclosed chamber of said container in such a manner as to only partially fill said chamber leaving a portion at the top of said chamber unfilled;

positioning a plurality of elongated extensions of said container that are in fluid-flow communication with said portion of said chamber above the surface level of said volatile liquid in dispersed, spaced-apart relation in said pavement to be heated with a continuous downward gradient in each of said extensions from the distal end thereof to said chamber;

circulating said heated primary fluid through a hollow conduit positioned inside said enclosed chamber in close physical contact with said volatile liquid to effect a heat transfer but not a fluid transfer from said primary fluid through said hollow conduit to said volatile fluid sufficient to cause at least a portion of said volatile liquid in said chamber to vaporize; and allowing the vapor to migrate from any portion of said container into any of said extensions as determined by the differential pressure gradients therein.

* * * * *